United States Patent [19]

Pentith

[11] 4,185,876

[45] Jan. 29, 1980

[54] PLURAL SPACED CUTTER DRUMS ON PIVOTABLE ELONGATE ARM WITH LOADING MEANS IN THE SPACE

[75] Inventor: Gerald R. O. Pentith, Barnsley, England

[73] Assignee: Summit Mining Limited, Barnsley, England

[21] Appl. No.: 810,420

[22] Filed: Jun. 27, 1977

[51] Int. Cl.[2] ..... E21C 27/24

[52] U.S. Cl. ..... 299/45; 299/1; 299/46; 299/80

[58] Field of Search ..... 299/1, 31, 42–46, 299/53–61, 87, 71

[56] References Cited

U.S. PATENT DOCUMENTS

| | | | |
|---|---|---|---|
| 1,700,294 | 1/1929 | Levin | 299/45 |
| 2,981,527 | 4/1961 | Kircher et al. | 299/44 X |
| 3,170,732 | 2/1965 | Hlinsky | 299/71 |
| 3,219,389 | 11/1965 | Lanfermann | 299/53 |
| 3,288,533 | 11/1966 | Gonski | 299/57 |
| 3,371,964 | 3/1968 | Weber | 299/1 |
| 3,433,529 | 3/1969 | Mueller et al. | 299/45 X |
| 3,856,357 | 12/1974 | Wharton | 299/87 X |
| 3,888,544 | 6/1975 | Bennett | 299/87 X |
| 3,897,110 | 7/1975 | Agnew | 299/45 |
| 4,025,120 | 5/1977 | Balinov et al. | 299/43 |
| 4,027,918 | 6/1977 | Hujimori et al. | 299/87 X |

FOREIGN PATENT DOCUMENTS

| | | | |
|---|---|---|---|
| 1015810 | 1/1966 | United Kingdom | 299/43 |
| 177815 | 11/1966 | U.S.S.R. | 299/43 |

*Primary Examiner*—Ernest R. Purser
*Assistant Examiner*—Nick A. Nichols, Jr.
*Attorney, Agent, or Firm*—Trexler, Wolters, Bushnell & Fosse, Ltd.

[57] ABSTRACT

A gearhead for a shearer type mining machine comprising an elongate arm pivotally attachable at or about its mid-position to a shearer type mining machine to provide an arm pivot axis extending laterally with respect to the longitudinal axis of the arm, to one or each end of a mining machine, the arm carrying at or towards each end a spiral vane cutting drum, the adjacent drum peripheries being spaced apart to define a nip and the drums being rotatable about axes parallel to the arm pivot axis and being contra-rotatable, the vane or vanes of one drum being of opposite hand to the vane or vanes of the other drum. Mineral loading means is located within the nip provided by said drums, said mineral loading means may be in the form of an auger, a cowl, a paddle chain, or some other type of transporting mechanism, for assisting removal of the cut mineral.

9 Claims, 5 Drawing Figures

PLURAL SPACED CUTTER DRUMS ON PIVOTABLE ELONGATE ARM WITH LOADING MEANS IN THE SPACE

This invention relates to a gearhead for a shearer type mining machine and to a mining machine incorporating such a gearhead.

Known shearer type mining machines commonly employed on advancing or retreating long wall mineral faces have at least one spiral vane shearer disc or drum which is employed not only for cutting the mineral involved, e.g., coal, as the machine is reciprocated along the mineral face but also for assisting loading of the cut mineral onto an armoured scraper chain conveyor extending along the mineral face, on which conveyor the machine is mounted and/or guided.

Known machines incorporate either a single drum at one end of the machine, with or without a similar drum at the other end of the machine, or incorporate two drums at the same end of the machine. In all cases the drums are mounted at one end of an arm, the other end of which is pivotally attached to the machine, the arm being pivotable, under the control of a double-acting hydraulic ram.

With all these arrangements the displacement for loading purposes of the cut mineral by the vanes of the disc or drum has been assisted by the association of arcuate cowls with each drum and/or with ploughs. Cowls are therefore carried by the machine with a cowl support arm at the face side of the machine i.e. adjacent the mineral being extracted, while ploughs are hauled behind the machine to plough cut mineral up from the mine floor and on to the conveyor. However, apart from consuming additional machine traction power, cowls and ploughs also involve awkward and inconvenient handling and adjustment, after completing a run along the mineral face, when it is usually necessary to move a plough to the other end of the machine, while furthermore, their presence restricts the space available for other equipment. Also, with double drum arrangements it is usual for the cutting reactions transmitted from the drums to the machine to change when the machine changes direction, for one drum usually cuts from roof to floor and the other drum from floor to roof, so that one direction of cutting tends to urge a conveyor mounted machine into seating contact with the conveyor, while the other direction of cutting tends to lift the machine from the conveyor.

According to the present invention, a gearhead for a shearer type mining machine comprises an elongate arm pivotally attachable at or about its mid-position to provide an arm pivot axis extending laterally with respect to the longitudinal axis of the arm, to one or each end of a mining machine, the arm carrying at or towards each end a spiral vane cutting drum, the adjacent drum peripheries being spaced apart to define a nip and the drums being rotatable about axes parallel to the arm pivot axis and being contra-rotatable, the vane or vanes of one drum being of opposite hand to the vane or vanes of the other drum.

The invention also includes a shearer type mining machine provided at one or each end with a gearhead defined above, with means to displace the arm about its pivot axis. Such means may comprise a double-acting hydraulic ram.

Thus, by providing a gearhead and mining machine according to the invention, with a pair of contra-rotatable drums as defined above, the contra-rotation may be employed to ensure that both drums direct cut mineral into the nip, so that loading of cut mineral, in use, onto an associated conveyor is improved to the extent that the need for cowls and/or ploughs at least in their conventional location, is obviated. One reason for this is the increased exit area for cut mineral between the cutting drums and the conveyor compared with known machine constructions, while the gearhead and machine in accordance with the invention further enables the relative dispositions of the drums and the conveyor to be improved over known constructions, again to assist loading, because delivery of cut mineral can be arranged to take place at the height of the conveyor and it is not necessary, as with some known machines, at least when cutting in one direction along a mineral face, for the bulk of the cut mineral to pass beneath the machine or a part thereof before any attempt is made to load this mineral onto the conveyor.

It is however possible to provide the gearhead and machine in accordance with the invention with one or more arcuate cowls, to further enhance the loading effect of the contrarotatable drums, without however, re-introducing the disadvantages of prior art cowls because in accordance with this aspect of the invention, one arcuate cowl is associated with each drum. or a common cowl with two arcuate surfaces associated with both drums, at the nip between the drums, the cowl(s) being supported only from the gearhead.

Thus, by avoiding the provision of a cowl support arm, an increase of 5% to 15% on depth of web which may be removed in any cutting run is retained, while the cowl(s) are static and remain in place at the end of a cutting run and need not be moved over, in accordance with prior art practice.

Furthermore, an auger may be provided at the nip, supported solely from the gearhead and at the height of the conveyor, to further assist displacement and loading of cut mineral. Alternatively in place of the auger, a shrouded endless paddle chain mechanism may be provided at the nip between the drums again supported solely from the geahead, the shroud being displaceable to cover alternative runs of the paddle chain so that it operates with whichever is the leading drum, in use. In detail, the paddle chain extends laterally with respect to the associated conveyor, between a drive sprocket adjacent the gearhead, and a remote return sprocket, the sprockets being rotatable about upright axes.

Thus the auger or paddle chain are intended to sweep on to the conveyor mineral cut but not loaded by the cutting drums, particularly the leading drum.

In use, the drums may be employed with an upper leading drum, cutting for example three quarters of the thickness of the mineral seam, with the other drum being a lower trailing drum, to cut the remaining quarter of the seam. The leading drum may cut from roof to floor. Thus the auger or paddle chain would load from a table formed by mineral remaining behind the leading drum i.e., from the top of the quarter of the seam remaining to be cut by the trailing drum.

Preferably, the arm is located within the overall width of the machine. The arm may contain a split gear train driven from a power unit within the machine, the split gear train conveying power to each drum, and the latter may each be mounted on hubs containing sun and planet final reduction gearing.

In accordance with another feature of the invention, a fan is located between the drums in the nip, to deliver ventilating air in use, to the mineral face involved and to areas of the drums adjacent that face.

By employing a gearhead and machine in accordance with such a fan one is able to deliver to a mineral face approximately ten times the volume of ventilating air supplied by the conventional venturi shaft technique, in which a water jet is sprayed into a shaft to entrain air along the shaft to deliver the air/water vapour mix to the region of mineral cutting.

The fan may be provided with a housing mounted on the cowl means and may be connected to ducting along which fresh clean air may be supplied to the fan. The latter may be driven electrically or by gearing taken from the drives to the drums. The source of fresh clean air may be a conduit extending along the mineral face housing one or more bus bars and pressurised with such air, the conduit having a sealed slot, a sealing means thereof being displaceable by a pick-up arm extending from the machine and carrying a pick up means e.g. a pantograph to make contact with the one or more bus bars.

Furthermore, a mist generator may be located in the vicinity of the cowl means. Thus, a high speed spinner may have high pressure water e.g. at 500–600 p.s.i. sprayed on to its periphery to obtain fine water droplets and hence create a dust suppressing mist. The water may be delivered to the spinner at 1 gallon/min for example. The spinner may be located on an individual shaft gear driven from the gearhead, or may be mounted on the fan or on a shaft extension thereof and hence rotatable at the same speed as the fan.

In accordance with yet another preferred feature a radio-active probe may be located between the two drums of the (or each) gearhead, to enable cutting to follow accurately any undulations etc. in the mineral seam being extracted.

Thus by providing a gearhead and machine according to the invention, the probe may be operable in both directions of advance along the mineral face, and hence total control of the path followed by the drums in both cutting directions along the face is possible, with the result that optimum cutting of the mineral seam is ensured. This is in contrast to the known use of radio-active probes in mining machines, where the probe is only operable in one direction of advance along a long wall mineral face. Thus in prior art machines, whilst the provision of such a probe is of advantage, it is only effective in controlling half the mineral winning operations effected by the machine.

The radioactive probe may be of the form conventionally employed on mining machines as may be the control circuit for controlling the location of the cutting drums with respect to the gearhead.

Also concerning the accurate following of a mineral seam, in accordance with yet another preferred feature the machine may be provided with means to adjust the machine height position with respect to a conveyor extending along the mineral face, and on which the machine is mounted, in use.

Thus, when it is required for instance to elevate the leading drum to follow an increase in height of the seam, cutting of (floor) rock by the trailing drum can be avoided by elevating the machine with respect to the conveyor, by the means provided. Such means may take the form of hydraulic rams or jacks, wedges or cams to achieve this steering action. Such adjustment means may be provided between the machine proper and a sub-frame on which the machine is mounted, the sub-frame being provided with shoes and/or rollers adapted to engage the tops of the side walls of the individual pans which are secured together to form the conveyor.

In use, the adjustment means may be set in a mid-position so that the machine may operate along what may be termed a centre line, with the result that the machine may be raised or lowered, within the operating limits of the adjustment means, dependent upon the degree of rotation that is required to impart to the arm so that the drums may follow accurately a mineral seam of increasing or decreasing thickness.

The invention will now be further described, in greater detail, by way of example, with reference to the accompanying drawings, in which.

Figure 2:
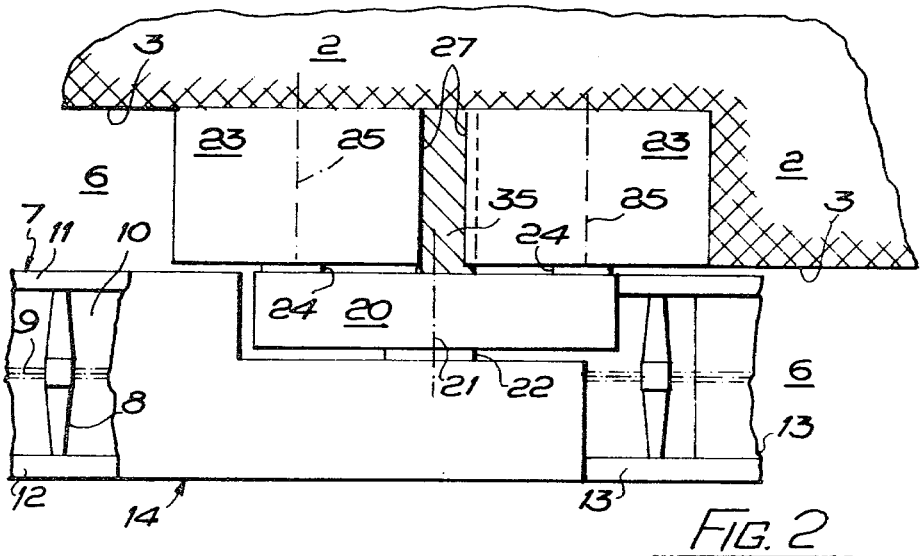
FIG. 2 is a plan view of FIG. 1 with part of a mining machine also being indicated.
Figure 4:
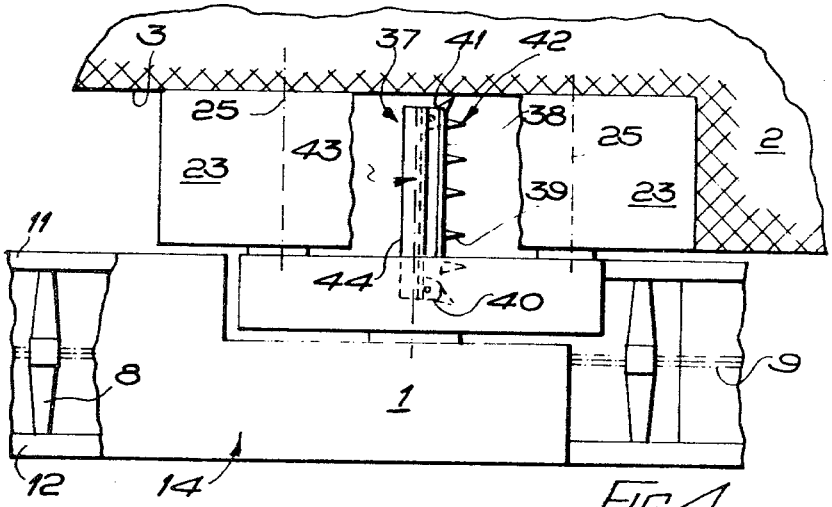

FIG. 4 corresponds to FIG. 2, but shows a paddle chain; and

Figure 5:
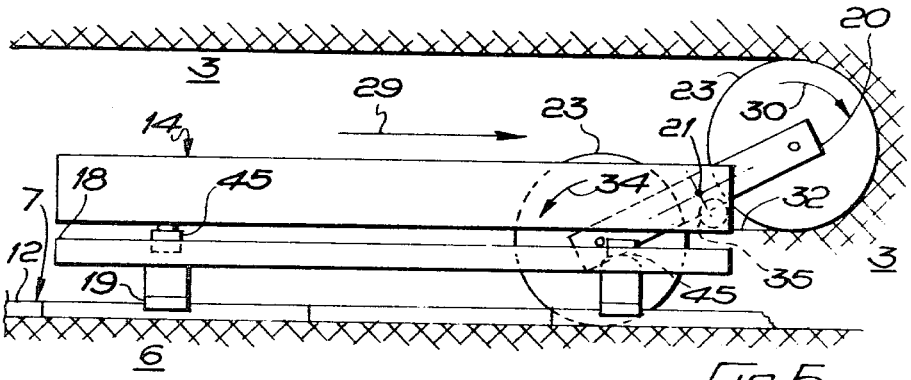

FIG. 5 shows another embodiment of shearer type mining machine looking towards the mineral seam being extracted.

Figure 3:
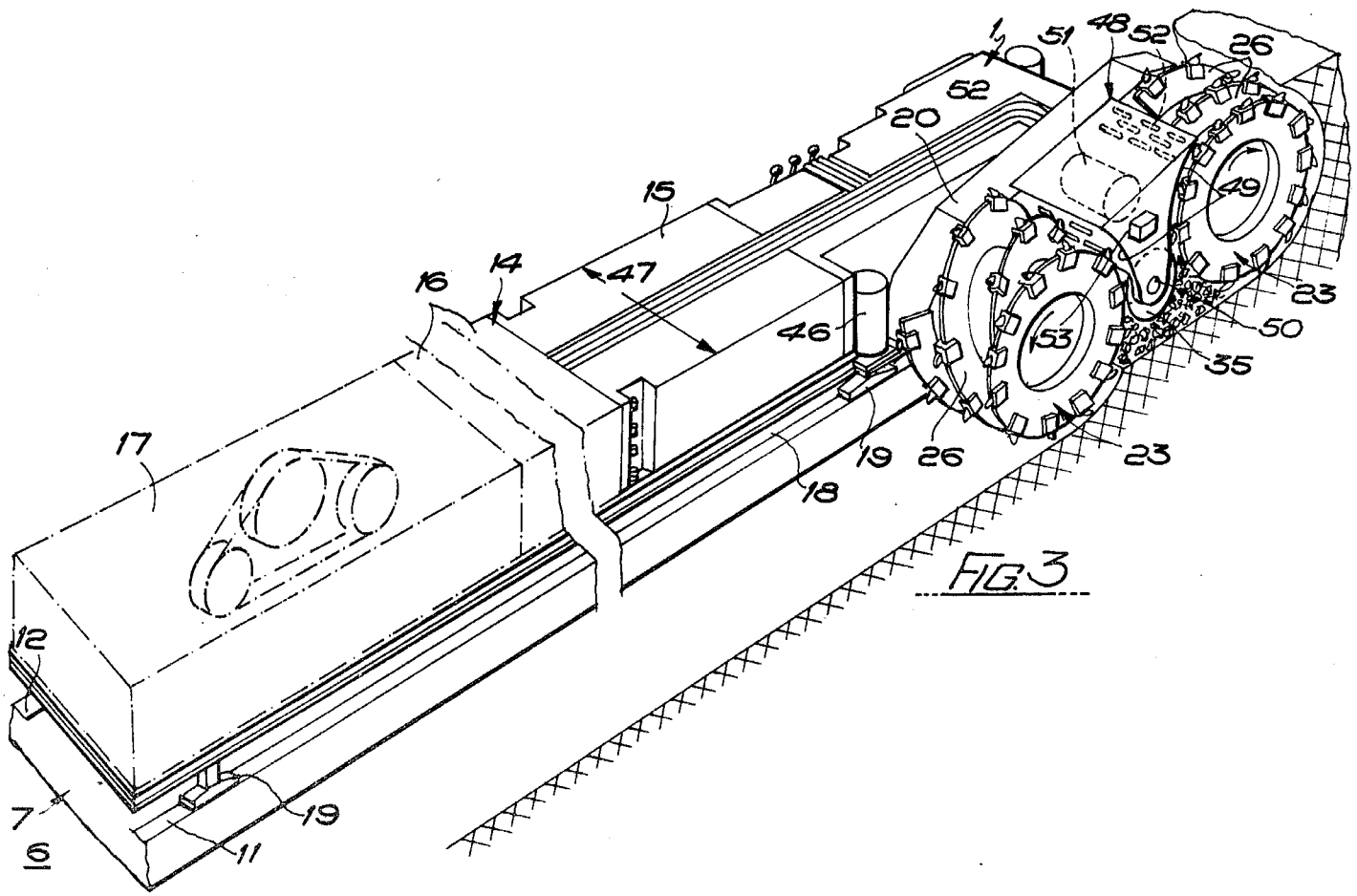
FIG. 3 is a perspective view of a gearhead and mining machine in accordance with the invention, looking from the opposite side to the elevation of FIG. 1.

In the drawings, a gearhead 1 is shown extracting a mineral seam 2 with a face 3 and a thickness 4 extending between a roof 5 and a floor 6. Along the face 3 extends a single chain scraper conveyor 7 having flight bars 8 and a haulage chain 9, the flight bars 8 in the conveying run being pulled along a deck plate 10 extending between a face side sidewall 11 and a goaf side sidewall 12 of the usual sigma section of individual conveyor pans 13 articulated together in the known manner so as to be capable of being "snaked" forward as the face 3 is advanced. A gearhead 1 is mounted at one or both ends of a shearer type mining machine 14 as best seen in FIG. 3, the machine 14 conventionally comprising a gearbox 15, an electric motor e.g. of 400 h.p. housed in a casing 16 and a machine haulage unit 17 of the "chainless" type described in British Pat. No. 1,352,543, the machine 14 being provided in the conventional manner with an underframe 18 having four guide shoes 19 by which the machine is mounted on and guided by the conveyor side walls 11 and 12.

Figure 1:
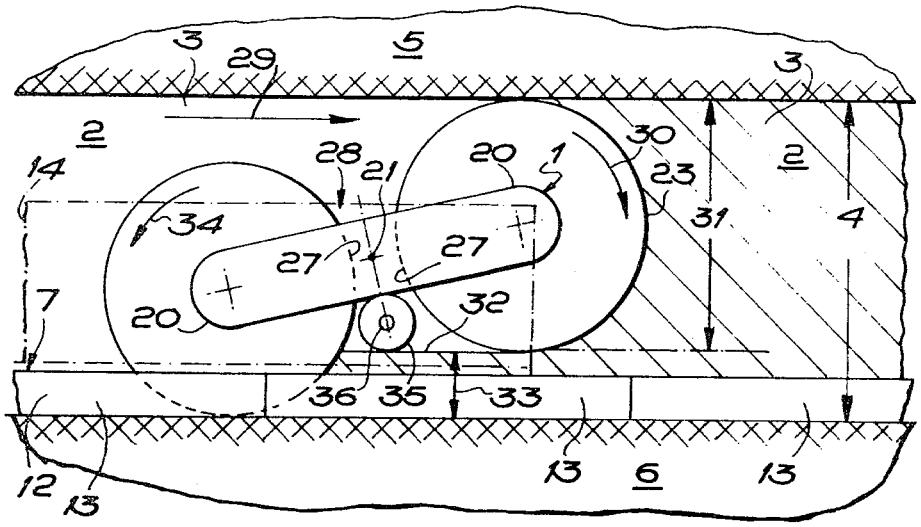
FIG. 1 is a diagrammatic side elevation of a gearhead in accordance with the invention, looking towards a mineral seam being extracted.

The gearhead 1 comprises an elongate arm 20 pivotally attached at its mid-position about an axis 21 extending laterally of the conveyor 7, to the mining machine 14 on a trunnion 22, the mining machine only being indicated in chain dotted line in FIG. 1. At or towards each end of the arm 20 is a spiral vane cutting drum 23, each drum being mounted on a trunnion 24 and each being rotatable at relatively slow speed e.g. 32 r.p.m. about an axis 25 parallel to the axis 21. Each drum 23 is conventionally provided, as indicated in FIG. 3, with one or more spiral, pick-carrying vanes 26. Adjacent peripheries 27 of each drum 23 are spaced apart to define a nip 28, along which nip mineral cut from the seam 2 is adapted to be displaced, for loading onto the conveyor 7. The gearhead 1 houses a gear train (not shown) connected to the gearbox 15 and also connected to a drive shaft coaxial with the trunnion 22 to transmit power to the drums 23 via two epicychic gear reductions contained in the arm 20.

In FIGS. 1 and 2, the mining machine 14 is cutting from left to right, as indicated by the arrow 29, with the leading drum 23 rotating clockwise, as shown by the arrow 30, so as to cut in the advantageous direction—from roof to floor—over the major thickness 31 of the seam 2, but so as to leave a shelf 32 of mineral of thickness 33 to be removed by the trailing drum 23, which is rotatable anti-clockwise, as shown by the arrow 34. It will be observed that the shelf 32 is located above the side walls 11, 12 of the conveyor 7, so as to enhance the cut mineral loading action. As indicated in the drawings, it is preferred to locate an auger 35 carried solely by the gearhead 1 and rotatable at relatively high speed e.g. 320 r.p.m. about an axis 36 parallel to the axes 21 and 25. The auger is located at the height of the shelf 32 and in the nip 28, again to assist the loading action of the vanes 26, particularly those of whichever is the leading drum. As will be apparent when an end of the face 3 is reached, the arm 20 is rocked about its axis 21 so that for a return cutting run, the drum 23, that was the trailing drum, now becomes the leading drum, and the drum that was the leading drum, now becomes the trailing drum.

In the embodiment of FIG. 4, a paddle chain 37 carried solely by the gearhead 1 replaces the auger 35 of FIGS. 1 to 3. The paddle chain comprises an endless chain 38 with projecting flights 39, a drive sprocket 40 adjacent the machine 14 and a return sprocket 41. A conveyor run 42 of the paddle chain 37 is exposed, which return run 43 is covered by a displaceable shroud 44. At the end of the face 3, when it is required to reverse the machine 14, the shroud is displaced to cover the run 42 and expose the run 43 for these two runs to reverse their roles upon reverse of the drive direction of the sprocket 40.

In the embodiment of FIG. 5 the machine 14 is mounted on the underframe 18 via four rams 45 adapted to provide pitch and roll steering of the machine 14 and hence to impart this steering to the drums 23 so that they may accurately follow the mineral seam 2. An alternative to this steering is indicated in FIG. 3, where instead of roll steering the entire machine 14, by employing only two rams 46, one at each side of the machine and by pivotally attaching the gearhead 1 to the gearbox 15, roll steering only of the gearhead 1 may be effected.

Referring again to FIG. 3, the arm 20 is located within the overall width 47 of the machine 14 while the arm 20 additionally carries a cowl 48 located in the nip 28 between the two drums 23, the cowl having two arcuate surfaces 49, one for each adjacent drum periphery. If as is preferred, a cowl 48 is provided, then the auger 35 may be supported by the cowl at point 50. Within the cowl 48 is located a high speed fan 51 adapted to ventilate the region of mineral cutting by blowing fresh, clean air through slits 52 in each surface 49. The fan 51 is mounted on a drive shaft (not shown) rotatable about an axis parallel to the axes 25 of the drums 23, and preferably incorporates a high speed spinner (not shown) to which high pressure water is supplied, so that the fan 51 constitutes a mist generator. Furthermore, the cowl 48 carries a radio-active probe 53, of known construction, for mineral seam identification.

The gearhead and mining machine in accordance with the present invention make it possible to exploit fully the benefits of slow speed cutting e.g. reduction of air borne dust, reduction of fines, improve loading etc., by specifically providing a gearhead capable of transmitting high horse powers at relatively slow speeds to attain maximum reliability and to introduce additional advantages which may be summarised as follows. By obviating the need for cowls, and in particular their support arms, one may attain an increase of at least 10% on the depth of web which may be cut in any run of a machine. There is provided improved loading of the cut mineral e.g. coal, by reducing the production of fines and dust, particularly if a high speed loading auger is used in place of a static cowl. There is provided improved cutting of mineral, by cutting the bulk of the seam in the preferred "roof to floor" direction at all times, in both directions of machine travel, and this also achieves a uniform torque reaction in both directions of machine travel, with the bulk of the mineral delivered at or above the height of the conveyor side walls. One may employ an improved cutting technique with slow peripheral pick speeds, by sharing the load between the two drums, so that the contra-rotation of the two drums tends to balance the torque reaction as each drum is cutting. There is provided improved turn around time at the end of a mineral face by avoiding the need for cowl turning and the need to make a hole in the roof and floor for the cowl to be turned. There is also provided the ability to adjust the height of mineral extraction by some 10 to 12 inches, to follow more accurately any variations in the mineral seam thickness.

What I claim is:

1. A shearer type mining machine including a gearhead, which gearhead comprises an elongate arm pivotally attachable at or about its mid-position to one end of said shearer type mining machine, to provide an arm pivot axis extending laterally with respect to the longitudinal axis of the arm, a spiral vane cutting drum carried proximate each arm end, the adjacent drum peripheries being spaced apart to define a nip, a mineral loading means located in said nip, and said drums being rotatable about axes parallel to said arm pivot axis and being contra-rotatable, said vane or vanes of one of said drums being of opposite hand to said vane or vanes of the other of said drums means for pivoting said elongate arm to a position such that the leading cutting drum is in an elevated position with respect to the other lower trailing cutting drum in either direction of movement, so that the leading cutting drum will remove the majority of the mineral seam cutting from roof to floor, while the trailing drum cuts from floor to roof, whereby the minerals removed by said leading cutting drum will not fall onto the lower trailing cutting drum.

2. A shearer type mining machine as claimed in claim 1, wherein said elongate arm is located within the overall width of said machine.

3. A machine as claimed in claim 1, wherein said mineral loading means comprises a cowl common to both said drums, said cowl having an arcuate surface adjacent each said drum periphery.

4. A machine as claimed in claim 1, wherein said mineral loading means comprises an auger supported from said gearhead.

5. A machine as claimed in claim 1, wherein said mineral loading means comprises a shrouded paddle chain solely supported from the gearhead, and having a shroud displaceable to cover alternative runs of said paddle chain.

6. A shearer type mining machine as claimed in claim 1 provided with means to adjust the machine height position with respect to a conveyor.

7. A shearer type mining machine as claimed in claim 6, wherein said adjustment means comprises four hydraulic rams.

8. A shearer type mining machine as claimed in claim 6, wherein said adjustment means is provided between said machine and a sub-frame on which said machine is mounted, said sub-frame being provided with shoes engaging the tops of the side walls of the individual pans which are secured together to form the conveyor.

9. A gearhead for a shearer type mining machine comprising an elongate arm pivotally attachable at or about its mid-position to one end of a shearer type mining machine to provide an arm pivot axis extending laterally with respect to the longitudinal axis of the arm, a spiral vane cutting drum carried proximate each arm end, adjacent drum peripheries being spaced apart to define a nip, a mineral loading means located in said nip and said drums being rotatable about axes parallel to said arm pivot axis and being contra-rotatable, said vane or vanes of one of said drums being of opposite hand to said vane or vanes of the other of said drums, said cutting drums being sized and spaced such that in the working position the respective peripheries do not overlap materially, means for pivoting said elongate arm to a position such that the leading cutting drum is in an elevated position with respect to the other, lower trailing drum, without regard for the direction of movement of the gearhead, such that the elevated cutting drum will remove the majority of the mineral cutting from roof to floor, while the lower trailing drum cuts from floor to roof, whereby due to peripheries of the drums not overlapping materially and the elevated drum cutting from roof to floor mineral removed by said leading cutting drum will not fall onto the lower trailing cutting drum.

* * * * *